United States Patent [19]

Cichinski

[11] 4,090,649

[45] May 23, 1978

[54] MAGNETIC NEEDLE THREADER

[76] Inventor: Adele R. Cichinski, 40 Ten Eyck Pl., Edison, N.J. 08817

[21] Appl. No.: 812,813

[22] Filed: Jul. 5, 1977

[51] Int. Cl.[2] ..... D05B 87/00

[52] U.S. Cl. ..... 223/99

[58] Field of Search ..... 223/99; 112/223, 224, 112/225; 43/1

[56] References Cited

U.S. PATENT DOCUMENTS

| | | | |
|---|---|---|---|
| 2,059,680 | 11/1936 | Carlson | 223/99 |
| 2,411,118 | 11/1946 | Schuster | 223/99 |
| 2,544,063 | 3/1951 | Biederman | 223/99 |

FOREIGN PATENT DOCUMENTS

| | | | |
|---|---|---|---|
| 1,046,724 | 7/1953 | France | 223/99 |

*Primary Examiner*—George H. Krizmanich
*Attorney, Agent, or Firm*—Robert A. Green

[57] ABSTRACT

The disclosure is of a needle threader including a magnetic pin which is used to find the eye of the needle and is inserted therein. The threader also includes a hook-like member which is of a magnetic material and which is pulled through the eye of the needle by the magnetic pin. Once the threader is pulled through the eye of the needle, a thread is inserted therein, and when the threader is pulled out of the eye, the thread is caught in the eye, and the needle is threaded.

4 Claims, 3 Drawing Figures

MAGNETIC NEEDLE THREADER

BACKGROUND OF THE INVENTION

Many needle threaders are known, and examples are shown in U.S. Pat. Nos. 424,518; 1,144,504; 2,042,403; 2,411,118; 2,567,408; and 3,404,707. However, none of these threaders is suitable for use in threading a needle which is fixed in place, such as the needle in a machine. Generally, these threaders include a flexible loop, and the loop is broken or distorted when it is used to hunt for the eye in a needle in a machine. With the apparatus of the invention, the pin is used to find the eye, and then the threader is used to perform the threading without its being subjected to possible damaging forces.

DESCRIPTION OF THE PREFERRED EMBODIMENTS

Figure 1:
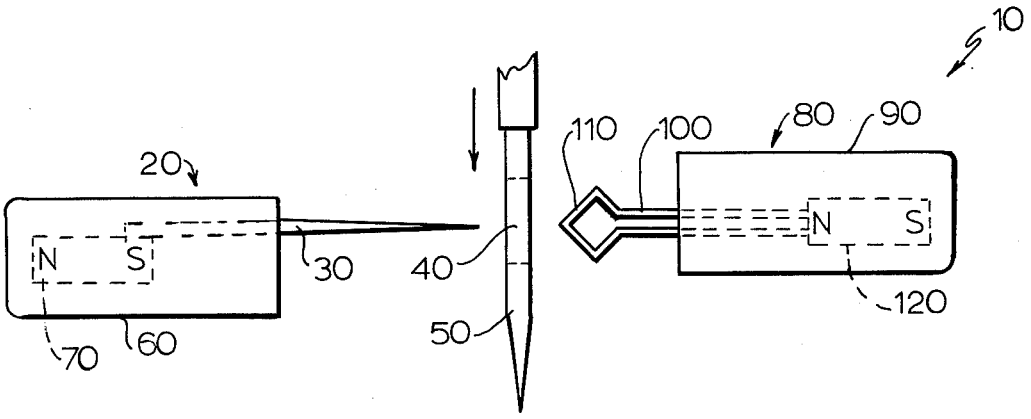
FIG. 1 is an elevational view of the invention illustrating one step in its use.

Needle threading apparatus 10 embodying the invention includes a first member 20 which comprises a relatively strong and rigid pin 30 of a size which can enter the eye 40 of a needle 50 to be threaded. The pin 30 is either a magnet itself, or it is of a magnetic material, and it is embedded in a suitable tubular holder 60 in contact with a magnet 70 embedded in the holder. The apparatus also includes a threader 80 of the type shown, for example in U.S. Pat. No. 3,404,707, which comprises a tubular holder 90 carrying a flexible wire 100 of magnetic material which is shaped at about its midpoint to form a loop 110. The loop is of a size which can be inserted through the eye of the needle. The loop 110, of course, it outside the holder 90, and the remainder of the wire 100 is inside the holder where its ends are in contact with, and may be secured to, a magnet 120 embedded in the holder.

In operation of the invention, assuming that the needle 50 is secured to the needle holder 130 of a machine, the user runs the pin 30 along the length of the needle until she finds the eye 40 and inserts the pin into the eye.

Figure 2:
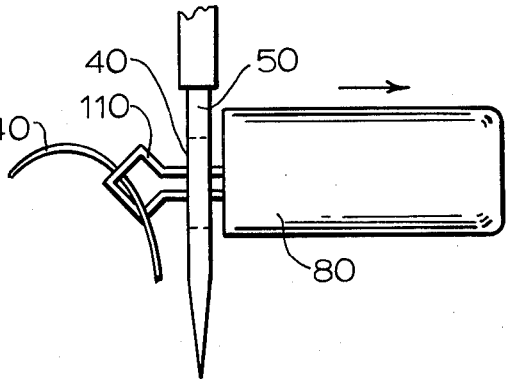
FIG. 2 is an elevational view of the invention at another step in its use.

The pin then is used to grasp the loop 110, due to magnetic attraction, and it is used to pull the loop through the eye (FIG. 2). The thread 140 is then easily inserted in the relatively large loop 110, and the threader 80 is then retracted and withdrawn from the eye. The loop is then disengaged from the thread, and the thread remains in the eye of the needle as desired.

Figure 3:
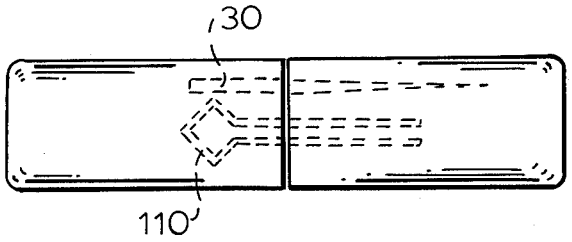
FIG. 3 is an elevational view of the invention showing the parts thereof assembled as a unit.

If desired, the tubular members 20 and 80 may be constructed so that one can be coupled to the other, with the pin and loop entering suitable apertures therein to form a compact carrying unit, as shown in FIG. 3.

It is noted that the magnets 70 and 90 are oriented to provide the desired attraction of the pin 30 to the loop 110.

What is claimed is:

1. A needle threader including a relatively rigid pin of a size and shape adapted to be inserted into the eye of a needle, said pin being of a magnetic material, and a second member including a loop of a flexible metal, said loop being of a magnetic material and adapted to be inserted in the eye of said needle due to its attraction to said pin, said loop being adapted to receive a thread when inserted through said eye.

2. A needle threader including a first housing including a magnet and carrying a relatively rigid pin of a size and shape adapted to be inserted into the eye of a needle, said pin being of a magnetic material and being in contact with said magnet, and a second housing including a loop of a flexible metal extending therefrom, said loop being of a magnetic material and adapted to be drawn through the eye of said needle due to its attraction to said pin and by said pin, said loop being adapted to receive a thread when inserted in said eye.

3. The apparatus of claim 2 wherein said second housing includes a magnet in contact with said loop.

4. The method of threading a needle comprising inserting a magnetic pin into the eye of a needle, coupling said pin to a loop of magnetic material, drawing said loop through the eye of the needle, disconnecting said pin from said loop, threading a thread through said loop, and withdrawing said loop from said needle to draw said thread through the eye of the needle.

* * * * *